United States Patent [19]

Dilling

[11] Patent Number: 4,587,813

[45] Date of Patent: May 13, 1986

[54] APPARATUS FOR APPLYING TREATMENT MATERIAL TO A TEXTILE MATERIAL

[75] Inventor: George R. Dilling, Rockford, Ill.

[73] Assignee: Reed-Chatwood, Inc., Rockford, Ill.

[21] Appl. No.: 649,665

[22] Filed: Sep. 12, 1984

[51] Int. Cl.[4] ..... D06B 3/18

[52] U.S. Cl. ..... 68/22 B; 118/405; 118/674

[58] Field of Search ..... 68/22 B, 175; 118/674, 118/404, 405

[56] References Cited

U.S. PATENT DOCUMENTS

| | | | |
|---|---|---|---|
| 2,784,583 | 3/1957 | Dungler | 68/22 B X |
| 4,193,762 | 3/1980 | Namboodri | 68/175 X |
| 4,340,623 | 7/1982 | Justus | 118/405 X |

FOREIGN PATENT DOCUMENTS

| | | | |
|---|---|---|---|
| 1167512 | 8/1958 | France | 118/405 |
| 1134973 | 11/1968 | United Kingdom | 68/22 B |

*Primary Examiner*—Philip R. Coe

*Attorney, Agent, or Firm*—Leydig, Voit & Mayer, Ltd.

[57] ABSTRACT

An apparatus for applying a foamed treatment material such as size to a textile material such as threads as the latter passes between a pair of drive rollers includes a frame which forms a pocket for the size above the rollers with the rollers forming the bottom of the pocket. A guide projects down into the pocket toward the line of contact between the drive rollers and the threads pass through a passage in the guide so that the threads are shielded from the size in the passage and only the lengths of thread between the lower end of the guide and the drive rollers are exposed to the size. In order that the application of size to the threads is comparatively uniform, the guide is raised and lowered in response to the speed of travel of the threads so that longer lengths are exposed at faster speeds and shorter lengths are exposed at slower speeds.

10 Claims, 10 Drawing Figures

APPARATUS FOR APPLYING TREATMENT MATERIAL TO A TEXTILE MATERIAL

BACKGROUND OF THE INVENTION

In the textile industry, it is common to apply a treatment material to a textile material. For example, size may be applied to threads to facilitate their handling in subsequent operations while finishing agents such as dye and waterproofing may be applied to woven fabrics. This is done through the use of an apparatus which holds a quantity of treatment material, often in foam form, in a pocket and the textile material is drawn through the pocket. Frequently, the apparatus does not have its own power source to draw the textile material and, instead, the power of the apparatus which performs a subsequent operation is used. Such a subsequent operation, however, may not advance the textile material at a steady rate with the result that some portions pass through the pocket of treatment material at a comparatively slow speed and other portions pass through at a comparatively high speed. Because of this, the treatment material is not applied uniformly to the textile material with the slower portions receiving too much and the faster portions too little.

SUMMARY OF THE INVENTION

The general object of the invention is to provide a new and improved apparatus of the above type which applies the treatment material substantially uniformly along the length of the textile material even though the latter is drawn through the apparatus at speeds which vary significantly.

A more detailed object is to achieve the foregoing by varying the length of the portion of material exposed to the treatment material according to the speed at which the textile material travels with a longer length being exposed at higher speeds and a shorter length at slower speeds.

Still another object is to vary the length of exposed textile material by passing the latter through a guide which projects down into the pocket of size so that only the portion of textile material beneath the guide is exposed to treatment material and to raise and lower the guide in response to changes in the speed of the textile material.

The invention also resides in the novel construction of the guide and its cooperation with the drive rollers and in the means for distributing foamed size in the pocket through which the textile materials pass.

DETAILED DESCRIPTION OF THE PREFERRED EMBODIMENT

Figure 1:
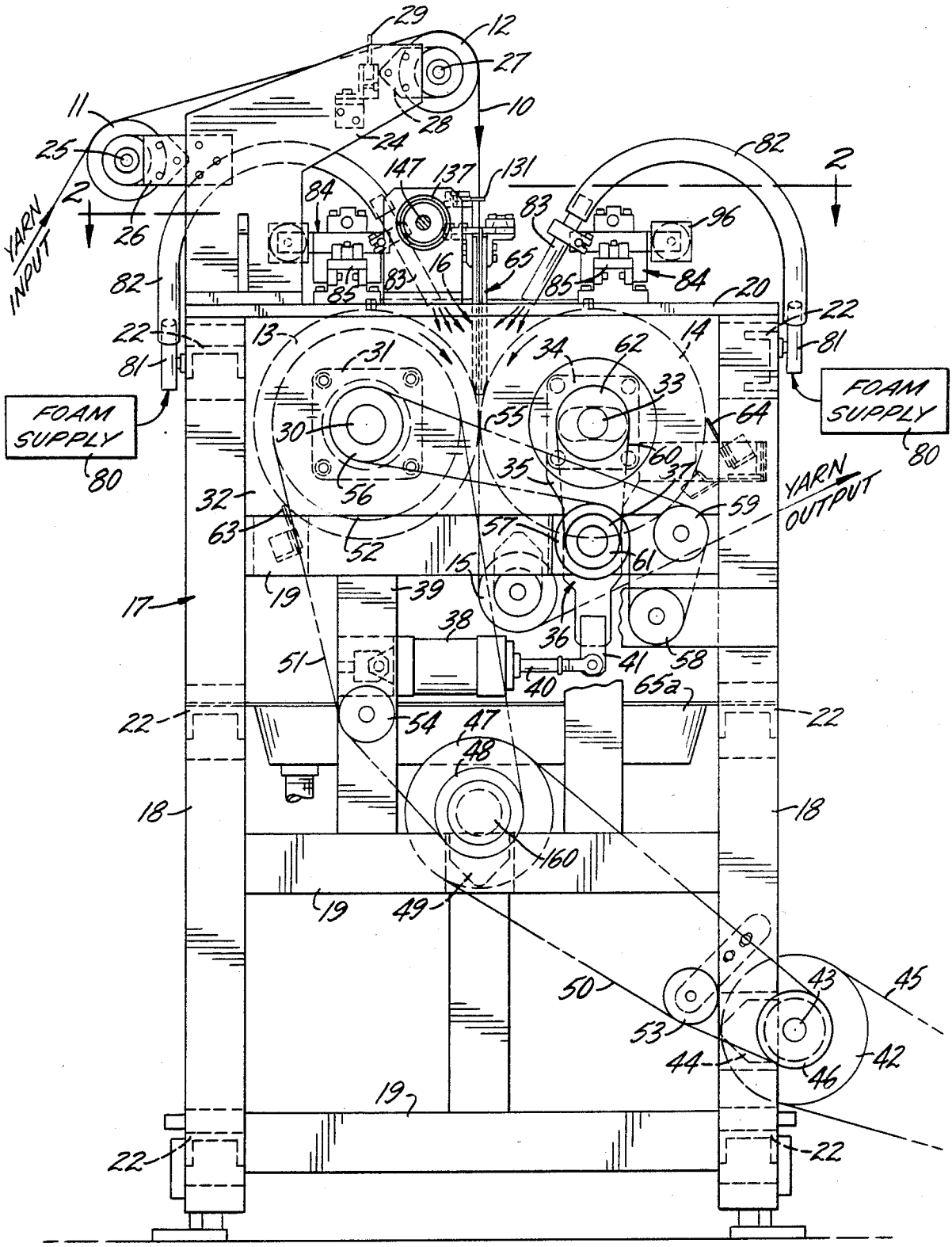
FIG. 1 is an end elevational view, as viewed generally along the line 1—1 in FIG. 2, of an apparatus embodying the present invention as used for applying size to threads.

In the textile industry, it is common to apply a treatment material to a textile material. For example, size may be applied to threads to facilitate their handling in subsequent operations while finishing agents such as dye and waterproofing may be applied to woven fabrics. The present invention relates to an apparatus for applying such a treatment material and, in the drawings as shown for purposes of illustration, the invention is embodied in an apparatus, commonly called a size box, for applying size to a plurality of threads 10 which are drawn side by side as from a beam (not shown) so that the threads may be handled more easily in subsequent textile operations. For this purpose, the threads are trained over horizontal guide rolls 11 and 12 and then travel down between parallel horizontal rollers 13 and 14 and around an idler roll 15 with the size being applied to the threads as they approach the rollers 13 and 14. The latter are in line contact and preferably are power driven to draw the threads over the guide rolls and through the pocket 16 (FIG. 4) defined by the upper sides of the drive rollers 13 and 14. The size is in the form of foam and is applied to the threads as the latter pass through the pocket 16.

Herein, the rolls 11, 12 and 15 and the drive rollers 13 and 14 are mounted on an elongated frame or base 17 which includes upright legs 18, horizontal cross bars 19 and top plates 20 spanning the legs at each end of the base. Spanning the legs along the sides of the base are longitudinal channel bars 22 (FIGS. 1 and 2) which are disposed near the top, bottom and middle of the frame and are bolted to the corresponding legs 18. Upstanding from the plates 20 and bolted to the latter at the rear of the base are brackets 24 (FIG. 1) and the shaft 25 of the guide roll 11 is journaled in plates 26 projecting rearwardly from the brackets. Similarly, the shaft 27 of the guide roll 12 is journaled in plates 28 projecting forwardly from the brackets and between the guide rolls is an upright comb 29 which is secured to the brackets and keeps the threads 10 separated as they pass over these rolls.

Figures 6, 7:
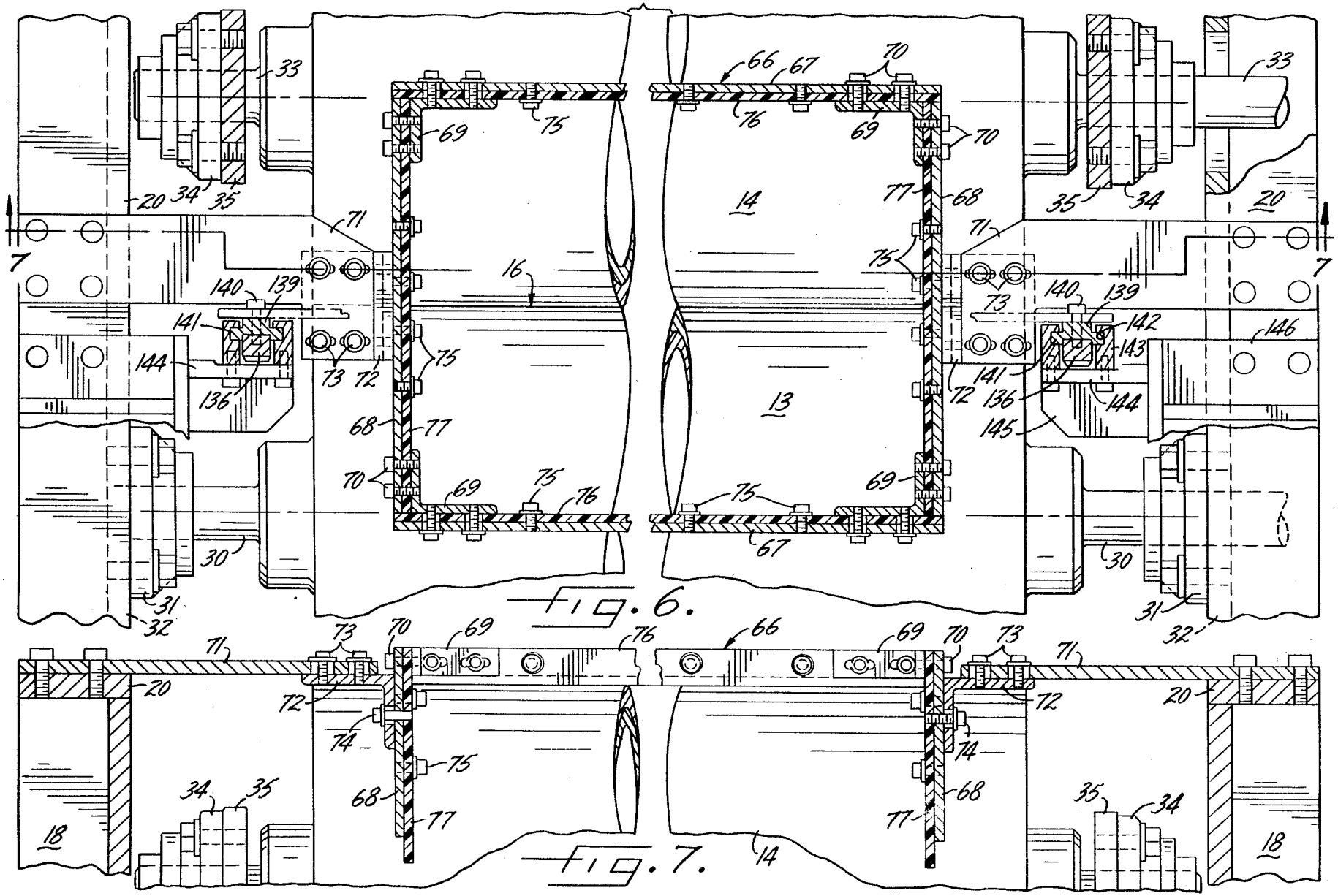
FIG. 6 is a fragmentary sectional view taken along the line 6—6 in FIG. 5, the guide having been removed for clarity.
FIG. 7 is a fragmentary sectional view taken along the line 7—7 in FIG. 6.

The drive rollers 13 and 14 extend longitudinally of the frame 17 and are disposed horizontally at the same level just beneath the top plates 20. Preferably, the roller 13 is mounted to turn about a fixed axis and the roller 14 is mounted to be swung between an active position in which it engages the roller 13 and an inactive position in which it is spaced from the latter to permit the threads 10 to be initially inserted between the rollers and to permit the rollers to be cleaned. For these purposes, the ends of the shaft 30 (FIGS. 1 and 6) of the roller 13 are journaled in bearings 31 bolted to vertical plates 32 on the upper portions of the ends of the base while the ends of the shaft 33 of the roller 14 are journaled in bearings 34 bolted to the upper arms 35 of upright levers 36. The latter are fulcrumed intermediate their ends to turn about a common longitudinal axis which is parallel to and beneath the shaft 33 and is defined by stub shafts 37, there being one such stub shaft for each lever and each being mounted on the adjacent cross bar 19 of the base and rotatably supporting the associated lever. To turn the levers and thus swing the roller 14 away from the roller 13, a cylinder 38 is pivotally mounted at one end to an upright brace 39 on the base and the free end of its piston rod 40 is pivotally connected to the lower arm 41 of one of the levers so that, by selectively admitting compressed air to one end or the other of the cylinder, the roller 14 is swung between its active and inactive positions.

Both of the rollers 13 and 14 are driven and, preferably, the stationary roller 13 is driven from a power source and the swinging roller 14 is driven from the stationary roller. Thus, a sprocket 42 (FIG. 1) keyed to a shaft 43, which is journaled in a bracket 44 on a leg 18 of the frame 17, is driven by a suitable power source (not shown) through a chain 45 and a second sprocket 46 fast on the shaft 43 drives a sprocket 47 which, with a sprocket 48, is keyed to a shaft (not shown) journaled in a bracket 49 that is secured to a cross bar 19 of the frame, this drive being through a chain 50. A third chain 51 is trained around the sprocket 48 and a sprocket 52 fast on the shaft 30 of the stationary roller to complete the drive to the latter. Idler sprockets 53 and 54 engage the chains 50 and 51 respectively to tension these chains. To drive the swinging roller from the stationary roller while permitting the former to swing, a chain 55 is trained around a sprocket 56 keyed to the shaft 30 of the stationary roller, over a sprocket 57 fast on the pivot shaft 37 of the adjacent lever 36 and around idler sprockets 58 and 59 which are journaled on the base 17. This drive is completed by a chain 60 which extends around a second sprocket 61 on the pivot lever 36 and a sprocket 62 on the shaft 33 of the swinging roller and the various sprockets are sized so that the two drive rollers turn at the same peripheral speeds. Doctor blades 63 and 64 are mounted on the base adjacent the drive rollers 13 and 14 respectively and engage these rollers to remove excess size which is collected in drip pan 65*a* (FIG. 1).

The present invention contemplates the provision of an apparatus constructed in a novel manner so that a treatment material is applied substantially evenly to the textile material even though the latter may travel through the apparatus at varying speeds. To this end, the textile materials such as the threads 10 pass through a vertical guide 65 as they travel through foamed treatment material in the pocket 16 above the drive rollers 13 and 14 and the guide shields the textile material from the treatment material until they pass out the lower end of the guide, that is, the textile material is exposed to the treatment material only for the distance between the lower end of the guide and the line of contact between the drive rollers. Further, in accordance with the invention, this distance is varied by raising and lowering the guide so that the distance is greater when the textile material is running faster and less when it is running slower. Thus, by correlating the distance with speed of the textile material, the exposure of the latter to the treatment material remains substantially uniform even though the speed is varied.

Figures 4, 5:
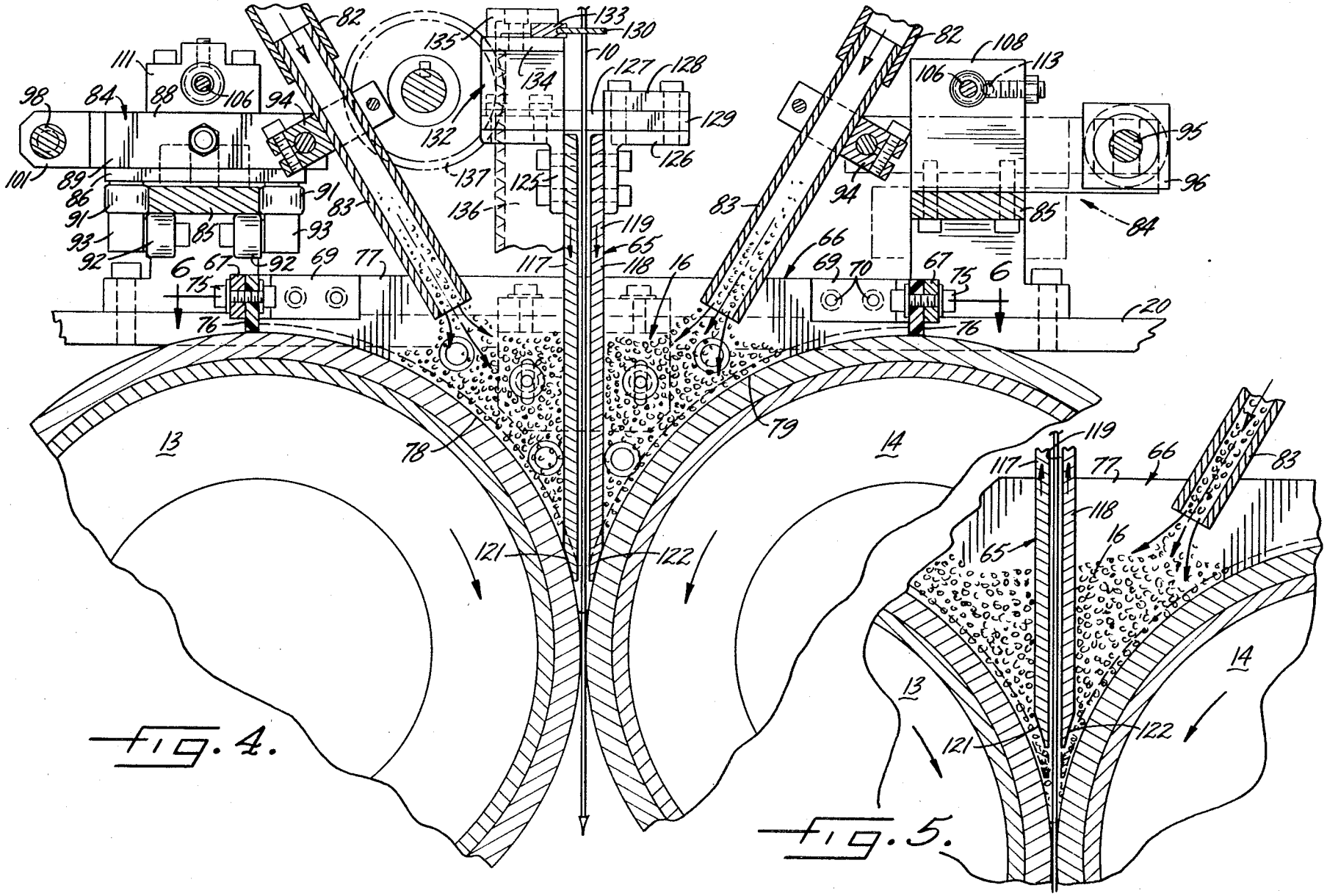
FIG. 4 is an enlarged fragmentary sectional view taken along the line 4—4 in FIG. 2.
FIG. 5 is a view similar to FIG. 4 but shows the guide in a moved position.

In order to contain the treatment material, herein foamed size, in the pocket 16, a pool is defined by a box-like frame 66 (FIGS. 4, 6 and 7) which is supported by the base 17 and engages the upper sides of the drive rollers 13 and 14. This frame includes side bars 67 (FIGS. 6 and 7) with one extending longitudinally along the top of each roller and end bars 68 spaced inwardly slightly from the ends of the rollers and spanning the ends of the side bars, the side and end bars being fastened together at the corners of the frame by angle brackets 69 and bolts 70. The frame is supported on the base by two elongated plates 71, one at each end of the base and each fastened to the adjacent end of the frame. Thus, one end of each plate is bolted to the corresponding top plate 20 of the frame and the plate 71 projects inwardly toward the adjacent end bar 68 of the frame. The inner end portion of the plate is fastened to the horizontal leg of an angle bracket 72 by bolts 73 and the horizontal leg of the bracket is fastened to the end bar by bolts 74. Extending along the inner sides of the side and end bars respectively and clamped to the latter by bolts 75 are resilient plastic plates 76 and 77. As shown in FIG. 4, the plates 76 bear lightly against the tops of the drive rollers 13 and 14 longitudinally thereof while the lower edges of the plates 77 are arcuate as indicated at 78 and 79 to conform to and engage the contour of the drive rollers and close the ends of the pocket 16.

Figure 2:
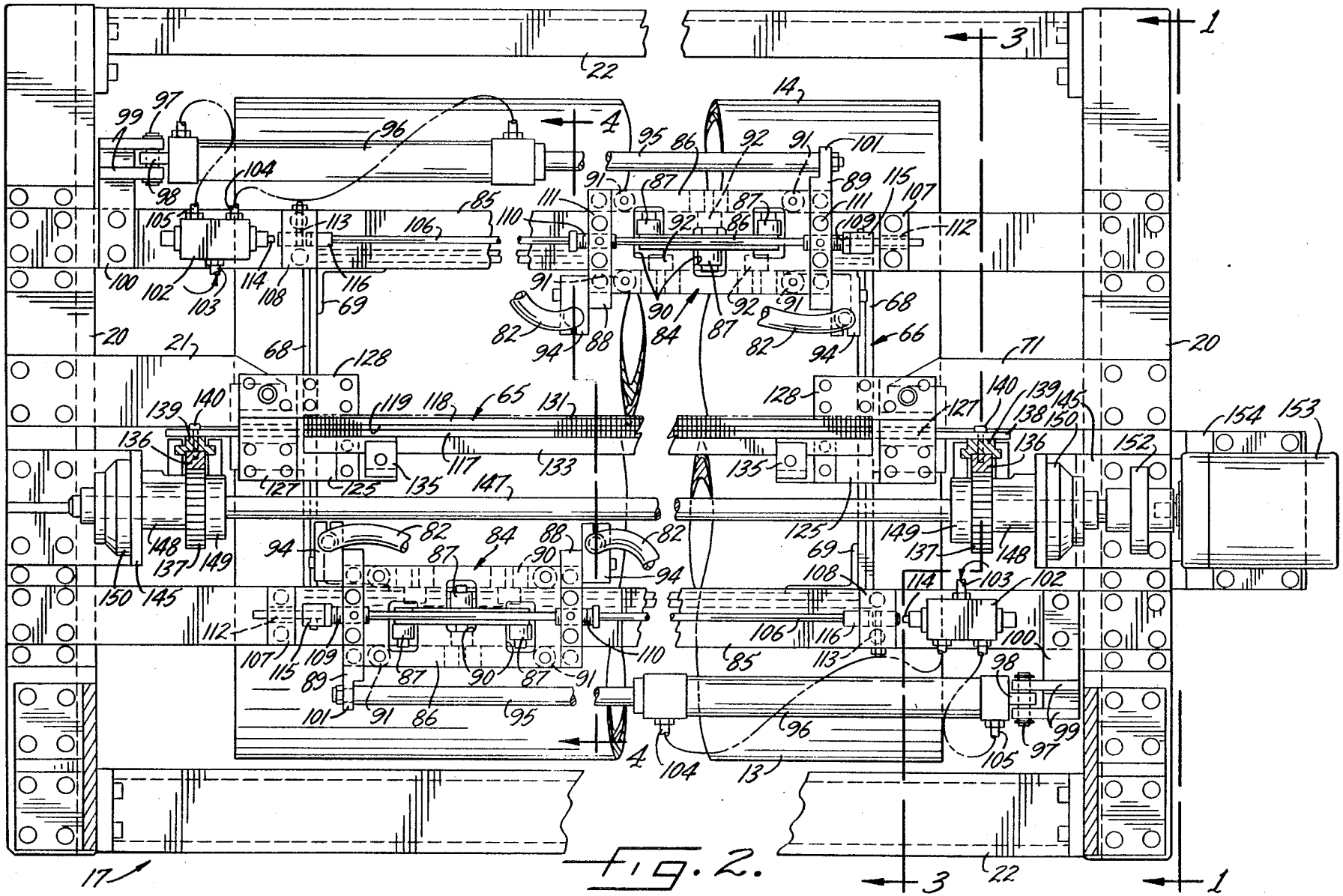
FIG. 2 is a sectional view taken along the line 2—2 in FIG. 1.
Figures 3, 3A:
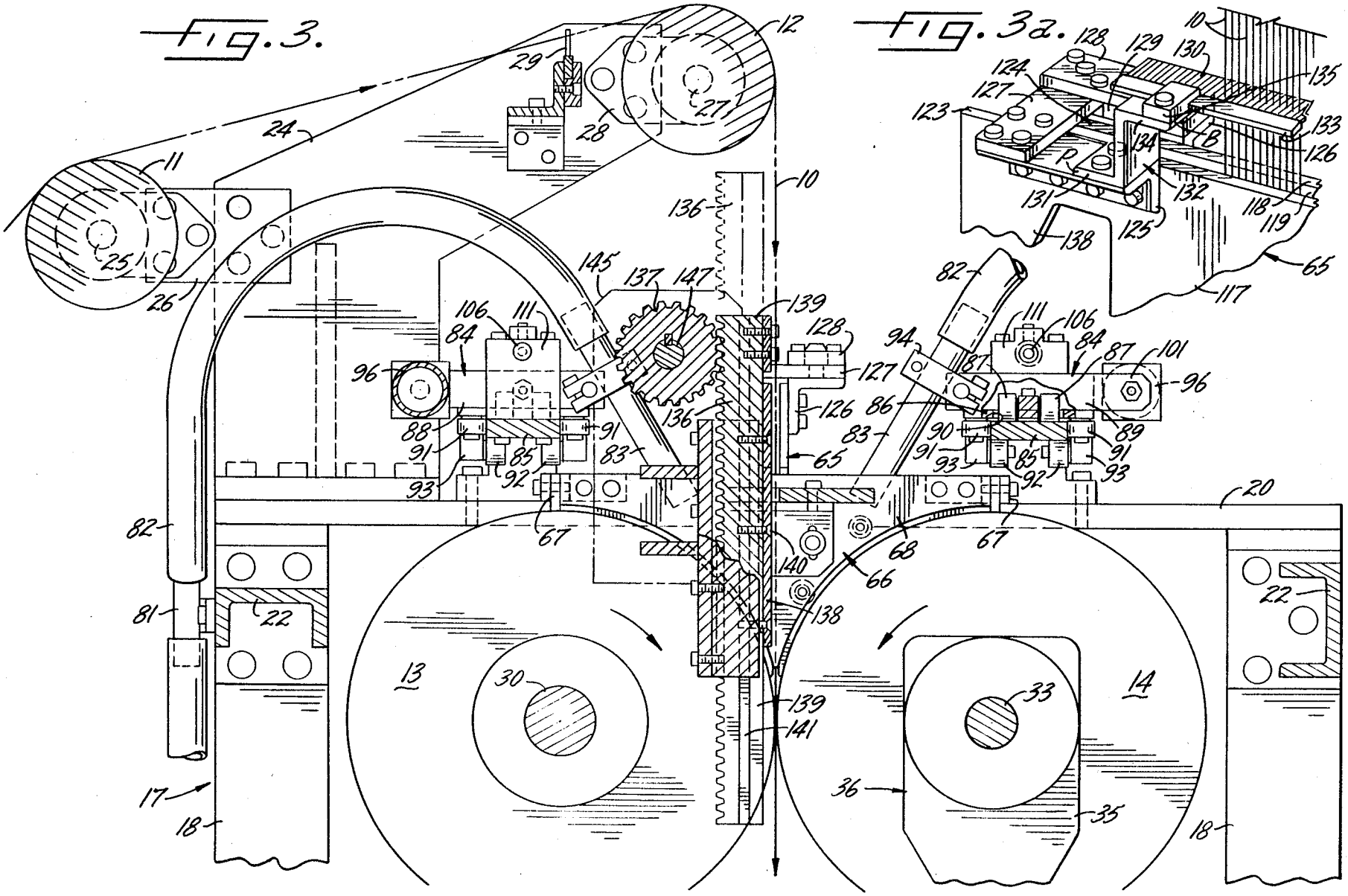
FIG. 3 is an enlarged fragmentary sectional view taken along the line 3—3 in FIG. 2.
FIG. 3*a* is an enlarged fragmentary perspective view of the means for supporting the guide.

To provide the pocket 16 with foamed size, the latter is pumped from a supply 80 through pipes 81 and hoses 82 to nozzles 83 which are disposed above the drive rollers 13 and 14 and direct the foam into the pocket. As shown in FIG. 2, there are four such hose and nozzle combinations with two on each side of the guide 65. In order that the foam is distributed fairly evenly throughout the length of the pocket, each pair of nozzles is supported by a carrier 84 which is power driven back and forth between the ends of the frame 17. The carriers travel on individual elongated tracks 85 which are rectangular in cross section and which span the ends of the base 17 with their end portions resting on top of and bolted to the top plates 20. Herein, each carrier includes a horizontal bar 86 (FIGS. 2 and 3) extending above and along the center of the associated track and rollers 87 are journaled through cutouts 90 in the central portion of the bar to turn about transverse axes and roll on the top of the track 85 (See FIG. 3). Secured to the ends of the bar 86 are cross members 88 and 89 and the sides of bar 86 are disposed just outside the edges of the track. Four rollers 91, one adjacent each corner of the carrier, are journaled on the undersides of the horizontal bar to turn about vertical axes and roll on the sides of the track 85 so that the carrier remains centered on the track as it moves back and forth. A third set of rollers 92 are journaled on brackets 93 depending from the horizontal bar and are disposed beneath the track. The rollers 92 turn about transverse axes and engage the underside of the track to hold the upper rollers 87 down on the track. The two nozzles 83 supported by the carrier are attached to the latter by means of clamps 94 bolted to the end bars 88 and 89.

Each carrier 84 is reciprocated by the rod 95 (FIG. 2) of an air cylinder 96 extending along the outboard side of the associated track 85. The head end of the cylinder is anchored by a pin 97 projecting through an ear 98 on the end of the cylinder and through the spaced legs 99 of the bracket 100 which is bolted to the track and the free end of the rod is secured to a projection 101 on the end bar 89 of the carrier. Reciprocation of the carrier is controlled by a valve 102 mounted on the track adjacent the bracket 100 and compressed air from a suitable source (not shown) is admitted to the valve through an inlet 103 and is alternately delivered to the rod end and the head end of the cylinder through outlets 104 and 105 under the control of the valve. To actuate the valve, an elongated rod 106 extends longitudinally of the track above the latter and its ends are supported in blocks 107 and 108 mounted on the track, the rod also passing through sleeves 109 and 110 threaded into smaller blocks 111 bolted to the tops of the end bars 88 and 89. The rod is supported for endwise shifting by a bearing 112 in the block 107 and by a two-position detent 113 in the block 108 so that the rod may occupy either of two longitudinal positions. The end of the rod adjacent the valve 102 opposes the actuator 114 of the latter and the actuator is depressed by the rod in one of its positions and released in the other position. Thus, the valve alternately directs compressed air to the head end and the rod end of the cylinder 96 as the rod is shifted back and forth. To shift the rod in response to the end travel of the carrier 84, a stop 115 fastened to the rod 106 adjacent the block 107 is engaged by the sleeve 109 as the carrier completes its travel away from the valve while the sleeve 110 engages an enlargement 116 on the rod as the carrier completes its travel in the opposite direction. Thus, when the sleeve 110 abuts the enlargement 116, the actuator is depressed to admit air to the head end of the cylinder and, then when the sleeve 109 abuts the stop 115 on the next stroke of the rod 95, the actuator is released so that air is admitted to the rod end of the cylinder.

Figure 8:
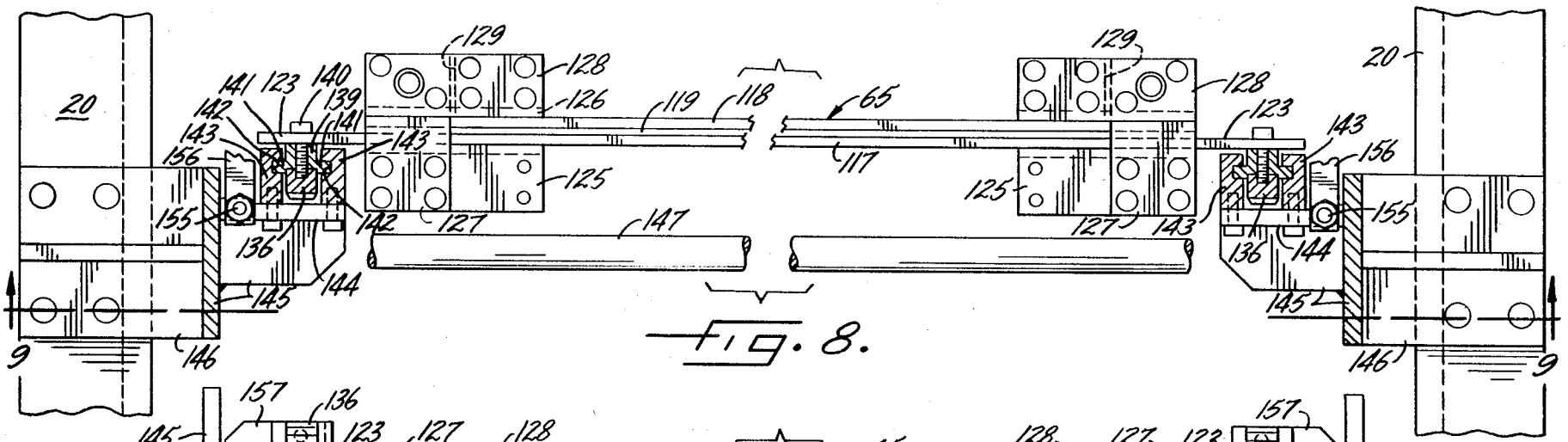
FIG. 8 is a fragmentary plan view with the means for mounting one of the combs removed for clarity.
Figure 9:
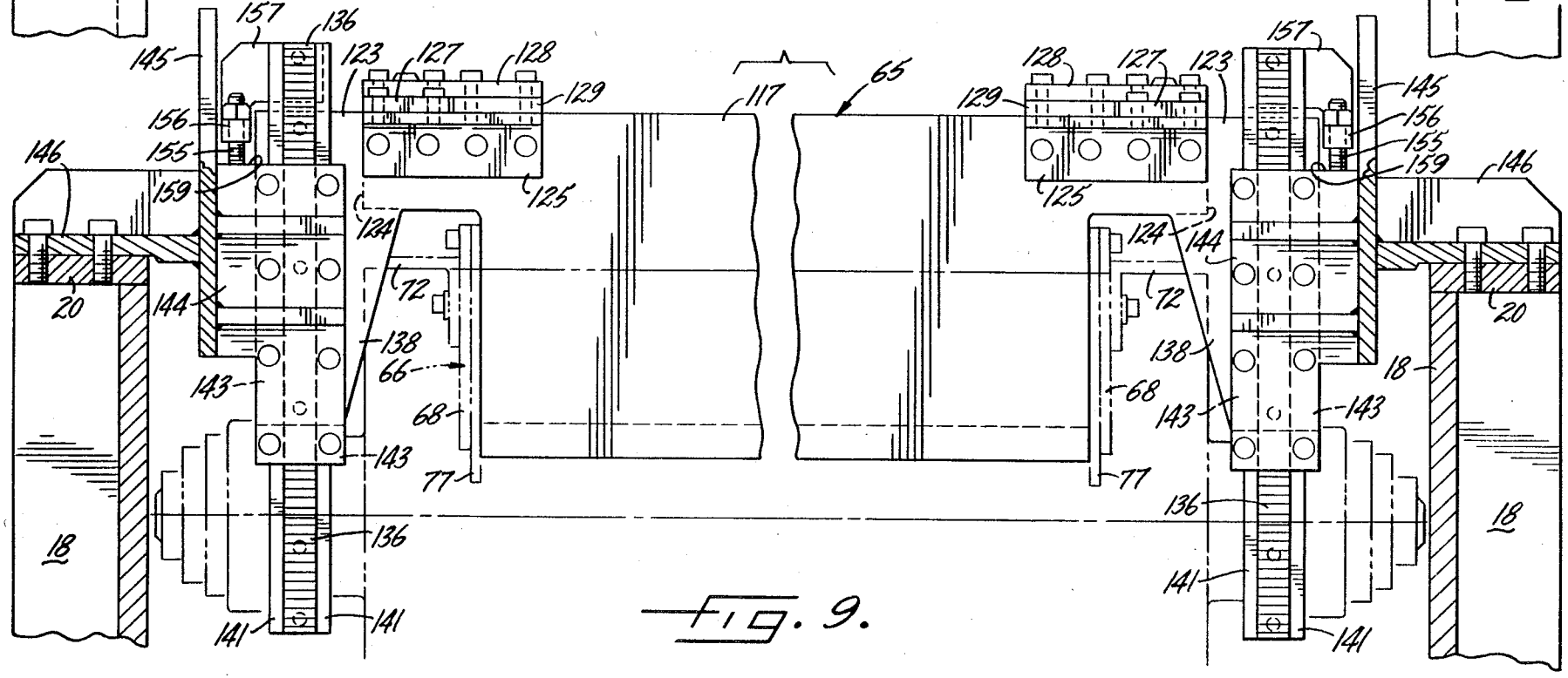
FIG. 9 is a fragmentary sectional view taken along the line 9—9 in FIG. 8.

Preferably, the guide 65 for leading the threads 10 through the pocket 16 is disposed over the line of contact between the drive rolls 13 and 14 and extends the full length of the frame 66, that is, from one resilient end plate 77 to the other as illustrated in FIG. 9. Herein, the guide is made up of two parallel and similarly shaped rectangular plates 117 and 118 which are spaced apart slightly (see FIG. 8) to define a narrow passage 119 through which the threads pass and in which they are shielded from the foamed size. The ends of the plates bear lightly against the resilient plates 77 of the size frame 66 and, as illustrated in FIGS. 4 and 5, along their lower edges are chamfered to provide arcuate surfaces 121 and 122 which mate with the drive rollers when the guide is in its lowermost position. Along their upper edge, the plates 117 and 118 extend over and beyond the ends of the frame 66 as indicated at 123 and 124 (FIG. 9) and each pair of these extensions are secured together at opposite sides of the passage 119. Thus, as to each such pair, an angle bracket 125 is bolted to the plate 117 along the upper edge thereof and a similar angle bracket 126 (FIG. 3*a*) is bolted to the plate 118. A strap 127 spans the outer halves of the angle brackets and is bolted to both brackets and a bar 128 overlies the strap and a spacer 129 above the bracket 126 with the bar, the strap and the spacer being bolted to the latter bracket. Thus, the plates are rigidly connected as a unitary component while being spaced to provide the passage 119. The brackets 125 also are utilized to support a second comb 130 which is disposed horizontally and extends along and above the passage 119 in the guide. For this purpose, the lower leg 131 of a Z-shaped mounting bracket 132 (FIG. 3*a*) is bolted to each bracket 125 and the back 133 of the comb spans and rests on the upper legs 134 of the mounting brackets where the back is clamped by jaws 135 bolted to the upper legs.

Means is provided to raise and lower the guide 65 to increase and decrease its spacing of the guide from the drive rollers 13 and 14 as the speed of the threads 10 through the apparatus varies. Herein, this means comprises a rack and a pinion and, preferably, two racks 136 (FIG. 2) are employed, one mounted at each end of the plate 117 and each meshing with and driven by an associated pinion 137. As shown in FIGS. 8 and 9, the racks are vertically disposed along flat arms 138 integrally formed on the extensions 123 of the plate 117 and are seated in vertical channel bars 139 which lie against these extensions, each channel bar and the associated rack being secured to the plate 117 by bolts 140. To guide the racks and hence the plate in their vertical movement, flanges 141 on the sides of each channel bar project into and slide in vertical grooves 142 in guide bars 143 which are bolted to a stationary cross plate 144. The latter is welded to a vertical plate 145 which, in turn, is welded to a horizontal bracket 146 bolted to a top plate 20 of the base 17.

As illustrated in FIG. 2, the pinions 137 are keyed to a horizontal shaft 147 which extends longitudinally of the base 17 and each pinion is located on the shaft by a sleeve 148 and a collar 149. At its ends, the shaft is journaled in bearings 150 which are mounted on the vertical plates 145 bolted to the top plates 20. At one end, the shaft is driven through a coupling 152 by a motor 153 which is bolted to a bracket 154 on the base. To prevent the plates 117 and 118 of the guide 65 from being jammed down against the drive rollers 13 and 14, positive stop means limits the downward travel of the racks 136 and hence of the plates. Herein, this stop means includes two adjustable stops 155 in the form of set screws (FIGS. 8 and 9) threaded vertically through ears 156 on plates 157 which are attached to the channel bars 139, there being one such stop assembly at each end of the guide 65. At the lower limit of the downward movement of the guide, each stop abuts the upper edge 159 of the stationary cross plate 144 which extends horizontally across and is bolted to the adjacent top plate 20 (FIG. 9).

Control means is provided to select a vertical position of the guide 65 according to the speed at which the threads 10 travel through the apparatus and to move the guide to that position. Thus, as the threads advance faster, the guide is raised to expose a greater length of each thread to the size while, conversely, the guide is lowered as the threads travel more slowly. The control means includes a device 160 (FIG. 1) responsive to the speed of the threads and controlling the motor 153 which positions the guide. Herein, the device 160 is a tachometer-generator which senses the speed of the sprocket 48 in the drive to the rollers 13 and 14 and the motor 153 is a synchronous motor connected to the tachometer generator to form a self-synchronous or Selsyn system. Thus, movement of the rotor of the tachometer-generator due to a change in the speed of the sprocket 48 is immediately followed by a corresponding movement of the rotor of the motor and hence by the appropriate vertical movement of the guide 65.

With the foregoing arrangement, the cylinder 38 is actuated to swing the drive roller 14 away from the drive roller 13 and threads 10 from a suitable source such as a beam (not shown) are placed over the guide roll 11, through the teeth of the comb 29, over the guide roll 12, through the teeth of the comb 131 and down through the passage 119 in the guide 65. From the guide, the threads pass between the drive rollers and around the roller 15 to a take-up apparatus (not shown) which conveniently may also provide the power for driving the rollers 13 and 14. The cylinder 38 then is energized to return the roller 14 to its active position in contact with the roller 13 and foamed size is delivered to the pocket 16 above the drive rollers through the hoses 82. When the drive rollers are driven by the chains 45, 50 and 51, the threads are pulled down through the pocket and the speed at which the threads travel is sensed by the tachometer 160. The latter controls the motor 153 which, through the pinions 137 and the racks 136, raise and lower the guide 65 as the threads travel faster and slower respectively. In this way, a comparatively uniform amount of size is applied to the thread regardless of their speed of travel. It will be understood that the same uniformity is achieved when other treatment materials are applied to various kinds of textile materials.

I claim:

1. In an apparatus for applying a treatment material to a length of textile material, the combination of, a frame, first and second elongated rollers disposed side by side to turn about parallel horizontal axes with the peripheries of the rollers engaging each other, means defining an elongated pocket above said rollers and extending along the line of contact between said rollers, means for directing said textile material vertically down through said pocket and between said rollers at said line of contact, mechanism for advancing said textile material through said rollers, means for supplying said treatment material to said pocket whereby the treatment material is applied to the textile material before the latter enters between said rollers, said means for guiding the textile material including an elongated guide extending horizontally along and above said line of contact and down toward the bottom of said pocket and into said treatment material, said guide having a vertical passage therethrough for said textile material whereby the latter is exposed to treatment material only below the guide, means supporting said guide for vertical adjustment whereby the space between the lower end of said passage and the bottom of said pocket may be varied for different speeds of travel of the textile material, and means responsive to the speed of travel of said textile material and operable to position said guide vertically in accordance with such speed of travel.

2. In an apparatus for applying a treatment material to a length of textile material, the combination of, a frame, first and second elongated rollers disposed side by side to turn about parallel horizontal axes with the peripheries of the rollers engaging each other, means for directing said textile material vertically down between said rollers at the line of contact thereof, mechanism for advancing said textile material through said rollers, means for supplying said treatment material to the pocket defined by said rollers on the upper sides thereof whereby the treatment material is applied to the textile material as the latter enters between said rollers, said means for guiding the textile material including an elongated guide extending horizontally along and above said line of contact and extending vertically from adjacent said line of contact to above said pocket, said guide having a vertical passage therethrough for said textile material whereby the latter is exposed to treatment material only below the guide, and mechanism supporting said guide for vertical adjustment whereby the space between the lower end of said passage and said line of contact may be varied for different speeds of travel of the textile material, the outer sides of said guide having arcuate portions along the lower edge of the guide, said arcuate portions substantially mating with said rollers adjacent said line of contact when the guide is lowered against the rollers.

3. The combination defined in claim 2 in which said pocket is defined by side walls, one extending longitudinally along each of said rollers, and by end walls spanning said side walls at opposite ends thereof, the lower edges of said end walls having arcuate portions complemental with the opposed portions of said rollers and all of said walls resiliently engaging the rollers.

4. The combination as defined in claim 3 in which said means for supplying treatment material to said pocket includes a carrier, means supporting said carrier above said pocket to travel back and forth between said end walls, power means to drive said carrier back and forth, and a nozzle adapted to be connected to a supply of treatment material and mounted on said carrier whereby the latter is distributed in said pocket as said carrier travels back and forth.

5. The combination as defined in claim 4 including a second and similar carrier and a second and similar nozzle mounted on said second carrier, the two carriers being on opposite sides of said guide and said power means being operable to drive said carriers in opposite directions.

6. In an apparatus for applying a treatment material to a length of textile material, the combination of, a frame, first and second elongated rollers disposed side by side to turn about parallel horizontal axes with the peripheries of the rollers engaging each other, means defining an elongated pocket above said rollers and extending along the line of contact between said rollers, means for directing said textile material vertically down through said pocket and between said rollers at said line of contact, mechanism for advancing said textile material through said rollers, means for supplying said treatment material to said pocket whereby the treatment material is applied to the textile material before the latter enters between said rollers, said means for guiding the textile material including an elongated guide extending horizontally along and above said line of contact and down toward the bottom of said pocket and into said treatment material, said guide having a vertical passage therethrough for said textile material whereby the latter is exposed to treatment material only below the guide, means supporting said guide for vertical adjustment whereby the space between the lower end of said passage and the bottom of said pocket may be varied for different speeds of travel of the textile material, a reversible power actuator connected to said guide and operable when energized to selectively raise and lower the guide, and means responsive to the speed of travel of said textile material and operable to energize said power actuator in a direction and to a degree to move the guide to a position correlated with the speed of travel of the textile material.

7. In an apparatus for applying a treatment material to a length of textile material, the combination of, a frame, first and second elongated rollers disposed side by side to turn about parallel horizontal axes with the peripheries of the rollers engaging each other, means defining an elongated pocket above said rollers and extending along the line of contact between said rollers, means for directing said textile material vertically down through said pocket and between said rollers at said line of contact, mechanism for advancing said textile material through said rollers, means for supplying said treatment material to said pocket whereby the treatment material is applied to the textile material before the latter enters between said rollers, said means for guiding the textile material including an elongated guide extending horizontally along and above said line of contact and down toward the bottom of said pocket and into said treatment material, said guide having a vertical passage therethrough for said textile material whereby the latter is exposed to treatment material only below the guide, an elongated vertical rack secured to said guide, means on said frame supporting said rack and hence said guide for vertical sliding whereby the space between the lower end of said passage and the bottom of said pocket may be varied for different speeds of travel of the textile material, a pinion journaled on said frame and meshing with said rack to slide the latter up and down, and a power actuator operable when energized to selectively turn said pinion in one direction or the other.

8. The combination as defined in claim 7 including means responsive to the speed of travel of said textile material and operable to energize said power actuator and position said guide according to such speed of travel.

9. The combination as defined in claim 7 including two racks with one secured to each end of said guide and each mounted to slide vertically on said frame, two coaxial pinions, one meshing with each of said racks, a shaft journaled on said frame with said pinions fast on said shaft, and means coupling said power actuator to said shaft to turn the latter.

10. In an apparatus for applying a treatment material to a length of textile material, the combination of, a frame, first and second elongated rollers disposed side by side to turn about parallel horizontal axes with the peripheries of the rollers engaging each other, means for directing said textile material vertically down between said rollers at the line of contact thereof, mechanism for advancing said textile material through said rollers, means defining an elongated pocket on the upper sides of said rollers and along said line of contact and including spaced side walls each extending longitudinally of the rollers and end walls spanning said side walls at opposite ends thereof, the lower edges of said walls being contoured to match the peripheries of said rollers and resiliently engaging the rollers, means for supplying said treatment material to said pocket whereby the treatment material is applied to the textile material as the latter enters between said rollers, said means for guiding the textile material including an elongated guide extending horizontally along and above said line of contact and extending vertically from adjacent said line of contact to above said pocket, said guide comprising a pair of rigidly connected plates disposed in parallel vertical planes and spaced apart to define a vertical passage therethrough for said textile material whereby the latter is exposed to treatment material only below the guide, and mechanism supporting said guide for vertical adjustment whereby the space between the lower end of said passage and said line of contact may be varied for different speeds of travel of the textile material, the outer sides of said plates having concave arcuate surfaces along their lower edges, said surfaces substantially mating with said rollers adjacent said line of contact when the plates are lowered against the rollers.

* * * * *